US008257188B2

(12) United States Patent
Monshouwer

(10) Patent No.: US 8,257,188 B2
(45) Date of Patent: Sep. 4, 2012

(54) CONJURER'S KIT

(75) Inventor: Herman Jacques Monshouwer, Huayyai (TH)

(73) Assignee: Hanky Panky Toys Thailand Ltd., Huayyai, Chonburi (TH)

( * ) Notice: Subject to any disclaimer, the term of this patent is extended or adjusted under 35 U.S.C. 154(b) by 129 days.

(21) Appl. No.: 12/660,011

(22) Filed: Feb. 19, 2010

(65) Prior Publication Data

US 2011/0207540 A1 Aug. 25, 2011

(51) Int. Cl.
*A63J 21/00* (2006.01)
*A63J 5/00* (2006.01)

(52) U.S. Cl. ..... 472/71; 472/81

(58) Field of Classification Search ..... 472/57, 472/61, 63, 71–74, 81
See application file for complete search history.

(56) References Cited

U.S. PATENT DOCUMENTS

| | | | | | |
|---|---|---|---|---|---|
| 2,280,315 | A | * | 4/1942 | Shipman | 472/63 |
| 4,026,066 | A | * | 5/1977 | Reiner et al. | 446/236 |
| 4,095,783 | A | * | 6/1978 | Bailey | 472/71 |
| 4,898,560 | A | * | 2/1990 | Moscovich | 446/85 |
| 5,348,220 | A | * | 9/1994 | Setteducati | 232/1 D |
| 5,392,161 | A | * | 2/1995 | Weder et al. | 359/861 |
| 5,787,618 | A | * | 8/1998 | Mullis | 40/219 |

* cited by examiner

*Primary Examiner* — Kien Nguyen
(74) *Attorney, Agent, or Firm* — Feldman Law Group, P.C.; Stephen E. Feldman

(57) ABSTRACT

A conjurer's kit is disclosed that comprises a box comprising a plurality of walls enclosing an interior wherein one of the front walls of the box has a display opening. The walls have black inside surfaces. The box defines a hiding space between a rear wall and a partitioning wall. The partitioning wall has a height smaller than the interior height of the box. The box has a bottom cover that covers the bottom of the hiding space and is made of a soft material such as foam or sponge or carpet. The box has at least one partly black outer surface such as a hollow cone with a black outer surface or an object having one black half or a playing card having a black back.

24 Claims, 8 Drawing Sheets

CONJURER'S KIT

FIELD OF THE INVENTION

The present invention relates in general to a conjurer's kit, especially for children.

BACKGROUND OF THE INVENTION

For children, it is fun to play to be a magician or conjurer. Thus, several kits have been developed for use by children with which they can play the same (or similar) tricks as performed by professional magicians or conjurers.

SUMMARY OF THE INVENTION

One specific trick is a trick involving disappearing objects, or objects changing from one shape to another shape. It is a specific objective of the present invention to provide a relatively simple and easy-to-use kit with which children can perform such trick. Such kit provided by the invention has the features of claim 1.

BRIEF DESCRIPTION OF THE DRAWINGS

These and other aspects, features and advantages of the present invention will be further explained by the following description with reference to the drawings, in which same reference numerals indicate same or similar parts, and in which.

DETAILED DESCRIPTION OF THE INVENTION

Figure 1:
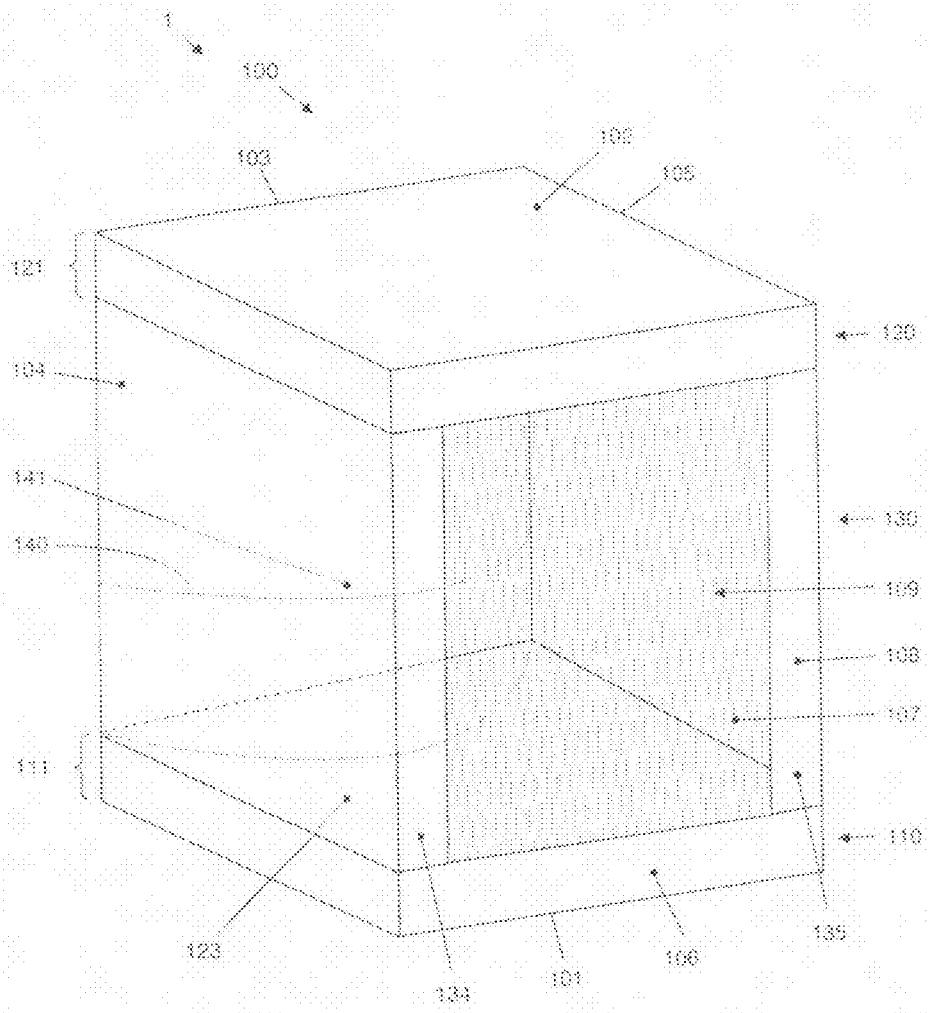
FIG. 1 schematically shows a perspective view of a box for use in a conjurer's kit according to the present invention.
Figure 2A:
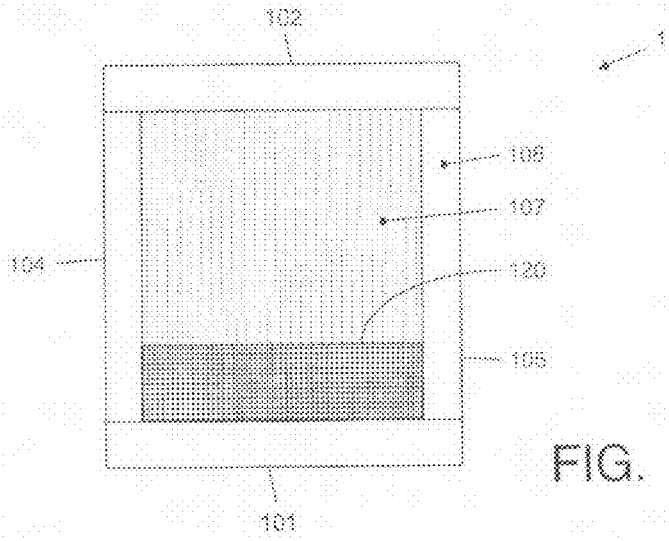
FIGS. 2A, 2B, 2C schematically show a front view, a top view in cross section, and a side view in cross section, respectively, of the box of FIG. 1.
Figure 2B:
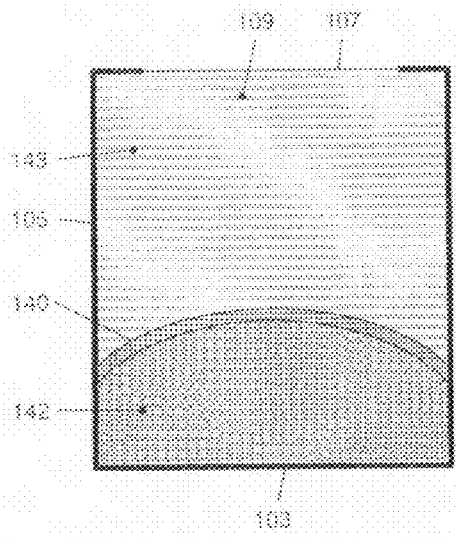
Figure 2C:
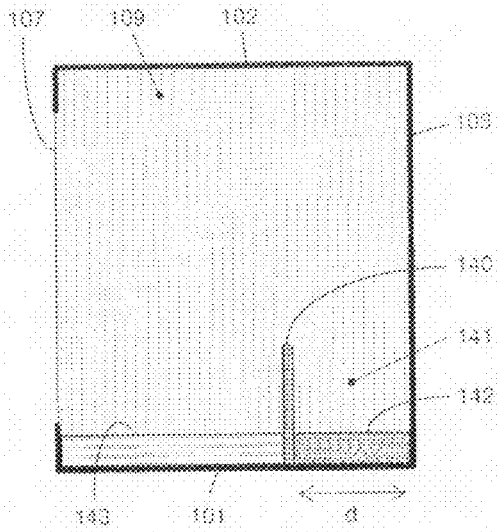

FIG. 1 schematically shows a perspective view of an embodiment of a box 100 for use in a conjurer's kit 1 according to the present invention. FIGS. 2A, 2B, 2C schematically show a front view, a top view in cross section, and a side view in cross section, respectively, of the box 100. The box 100 as shown has a general block shape, with a planar bottom 101, a top wall 102, a rear wall 103, side walls 104, 105, and a front wall 106. In the preferred embodiment shown, said walls are mutually perpendicular to each other, but different angles are within the scope of the present invention. For sake of simplicity, the top wall 102, rear wall 103, and side walls 104, 105 are planar, and are perpendicular to each other, but this is not essential in all embodiments.

Preferably, the box 100 is foldable. In a preferred embodiment, the box 100 comprises a bottom part 110, a cover part

120, and a wall part 130. The bottom part 110 consists of the bottom 101 and an upstanding rim 111 of a few centimeters high, which rim 111 in use will be directed upwards from the bottom 101. Likewise, the cover part 120 consists of the top wall 102 and an upstanding rim 121 of a few centimeters high, which rim 121 in use will be directed downwards from the top wall 102. The cover part 120 and the bottom part 110 may be mutually identical, but it is also preferred that one is somewhat smaller than the other such as to be nestable within each other. Particularly, the cover part 120 may be somewhat larger than the bottom part 110, so that these two parts together may form a storage box with the cover part 120 as lid. The wall part 130 consists of the rear wall 103, the two side walls 104, 105 foldably attached to the rear wall 103 at opposite edges, and two strips 134 and 135 foldably attached to the side walls 104, 105, respectively at the free edges thereof opposite the central rear wall 103. This assembly can be folded such as to fit in the above-mentioned storage box. In unfolded condition, the wall part 130 can be placed upright within the bottom part 110, and the cover part 120 can be placed over the wall part 130, such as to form the box 100. From FIG. 1 it can be seen that the front wall 106 has a large opening 107 surrounded by relatively small wall portions defined by portions of rims 111 and 121 and by said two strips 134 and 135, which together form a window 108 around said opening. Through the opening 107, which will hereinafter also be indicated as display opening, the interior 109 of the box 100 can be seen. The box 100, in this condition, can be used as a magical theatre for performing conjurer's tricks, as will be explained later.

The dimensions of the box 100 are not critical, but for practical use the box 100 may have depth, width and height in the order of 40-100 cm.

The outside surfaces of the box 100 may be provided with colorful decorations, as desired, and may even be provided with illumination. The inside surfaces of the walls of the box, including the top wall and the bottom, are of a very dark colour, preferably black.

The interior 109 may be entirely empty, but the preferred embodiment is not. In the preferred embodiment, the box 100 comprises a partitioning wall 140 standing upright on the bottom 101, having a height smaller than the interior height; a suitable height is in the order of about 10 cm. The partitioning wall 140 extends from the one side wall 104 to the opposite side wall 105, at a distance from the rear wall 103, which distance is suitably about one-third of the depth of the box, although this distance is not critical; a suitable distance d is in the order of about 15 cm. The partitioning wall 140 may be a planar wall parallel to the rear wall 103, but it may also be curved, as shown.

The space between the partitioning wall 140 and the rear wall 103 will be indicated as hiding space 141. The bottom of the hiding space 141 is covered with a bottom cover 142 of a soft material, such as foam, sponge, carpet, or the like. The floor of the interior 109 between the partitioning wall 140 and the opening 107 will be indicated as stage 143; this stage may be a part of the bottom 101, or may be raised by an insert having a black top surface, as shown in FIG. 2C.

The kit 1 further comprises at least one attribute having an at last partly black outer surface. The key aspect of this feature is that such surface, when held before the opening 107 and especially when placed inside the box 100, is virtually invisible to spectators located in front of the box 100. In the following, some examples of such attributes will be described, including the tricks the player/conjurer can perform.

Figure 3B:
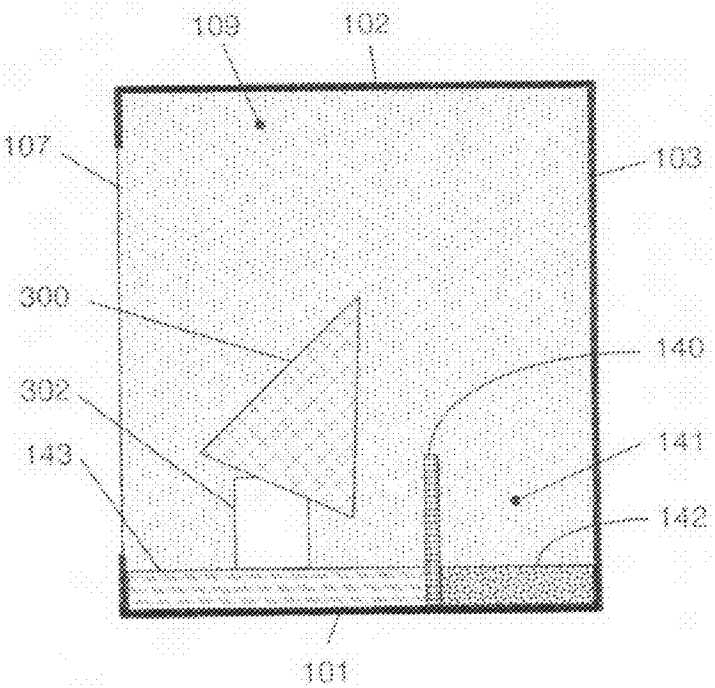
FIGS. 3A and 3B are views comparable to FIG. 2C, schematically illustrating a first trick.
Figure 3A:
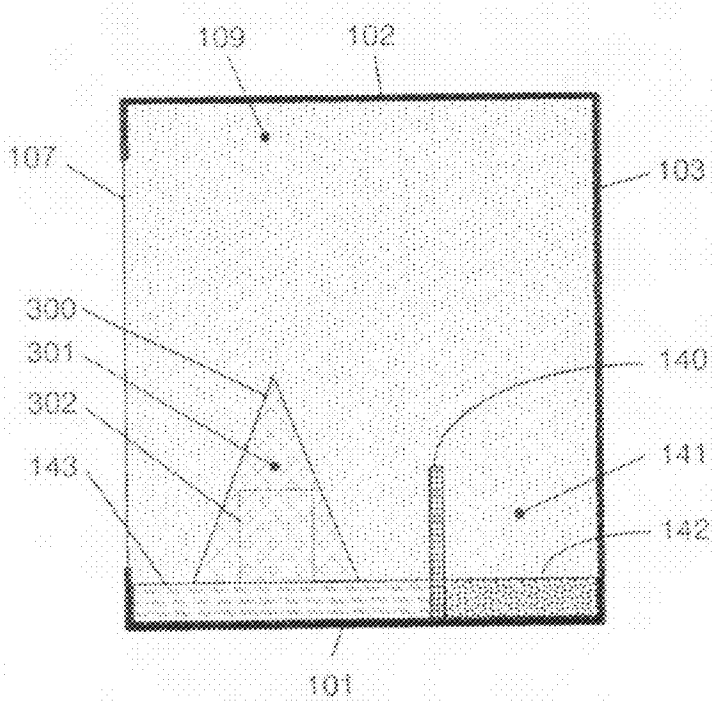
Figure 3D:
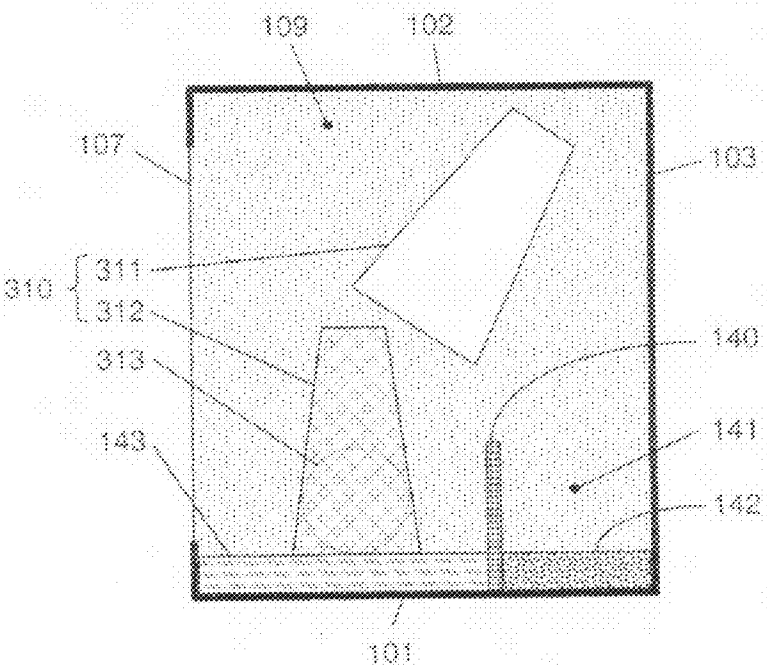
FIGS. 3C, 3D, 3E, 3F are similar views, schematically illustrating a variation of the first trick.

In a first example, illustrated in FIGS. 3A and 3B, an attribute 300 has the general shape of an inversed cup. In top view, the profile may be round or angular. In side view, the cross section may be Λ or Π, and actually the top may be open or closed. The attribute 300 of FIGS. 3A and 3B has a cone-shape. The outer surface of this attribute 300 is entirely black. The trick is played with a secondary attribute 302 fitting in the interior 301 of the attribute 300. The secondary attribute 302 is bright enough such as to be normally visible. The shape of the secondary attribute 302 is basically immaterial, but for increased suspense the shape may for instance be an animal. When the secondary attribute 302 is placed on the stage 143 with the attribute 300 placed over it, the secondary attribute 302 is invisible to the spectators (FIG. 3A). When the conjurer lifts the attribute 300 (which as such can not be seen by the audience), while pronouncing a magical formula, the secondary attribute 302 magically appears (FIG. 3B). To have his hands free, the conjurer may place the attribute 300 on the stage 143 or in the hiding space 141. When the conjurer places the "invisible" attribute 300 over the secondary attribute 302, while pronouncing a different magical formula, this secondary attribute 302 magically disappears (FIG. 3A).

Figure 3C:
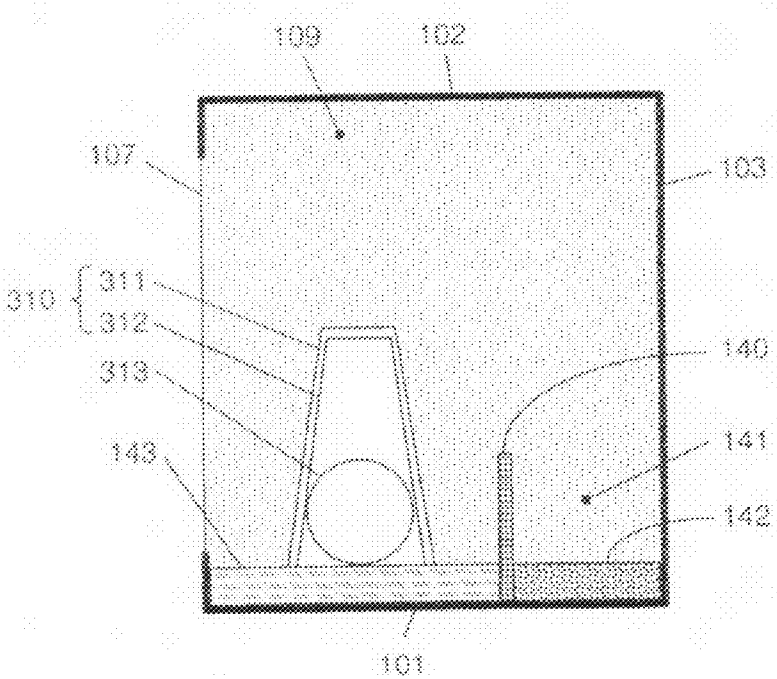
Figure 3F:
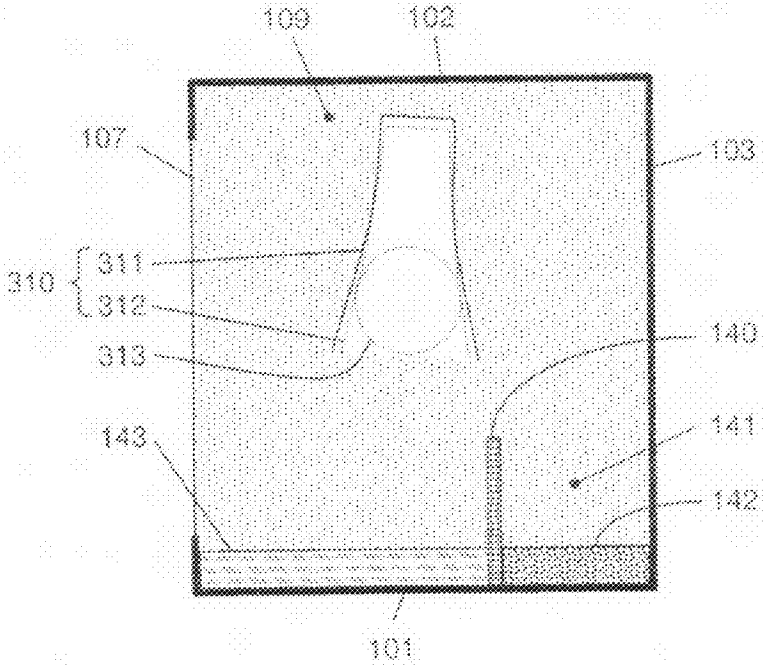
Figure 3E:
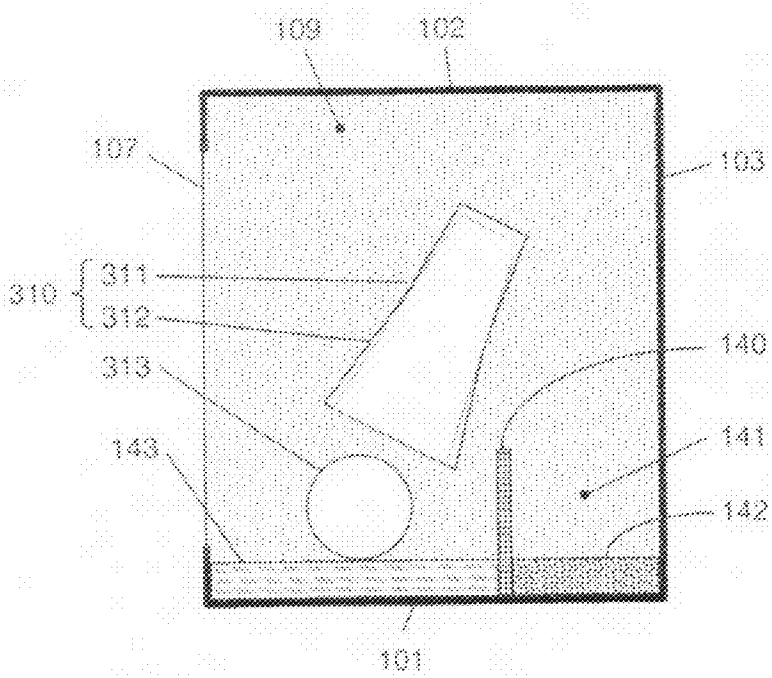

In a variation illustrated in FIGS. 3C-3F, an attribute 310 consists of two separate components 311 and 312 as well as a secondary attribute 313, which in the example shown is a ball having a bright colour such as to be clearly visible. The two separate components 311 and 312 are each similar to the attribute 300 discussed in the above, namely inverse-cup-shaped; in the example shown, each of said components 311 and 312 has the shape of a truncated cone. The two cones 311 and 312 are of soft and a flexible material, for instance plastic or rubber, and are of slightly different size so that they can be nested in each other. The smaller cone 312 has a completely black outer surface, while the larger cone 311 has a bright colour such as to be clearly visible. The ball 313 fits in the smaller cone 312. FIG. 3C shows the ball 313 placed on the stage 143 with the smaller cone 312 placed over the ball 313 and with the larger cone 311 placed over the smaller cone 312. The audience only sees the outer cone 311. Now the conjurer may pick up the outer cone 311 so that the inner cone remains standing over the ball 313 (FIG. 3D): the black inner cone 312 makes the ball 313 invisible to the audience. Alternatively, the conjurer may pick up the outer cone 311 while squeezing the outer cone 311 somewhat so that it will clamp the inner cone 312 and the inner cone 312 is lifted as well (FIG. 3E): now the clearly visible ball has magically appeared on the stage 143. Alternatively, the conjurer may pick up the outer cone 311 while squeezing even harder, so that both the inner cone 312 and the ball 313 are lifted (FIG. 3F): now the stage 143 is empty.

Figure 4B:
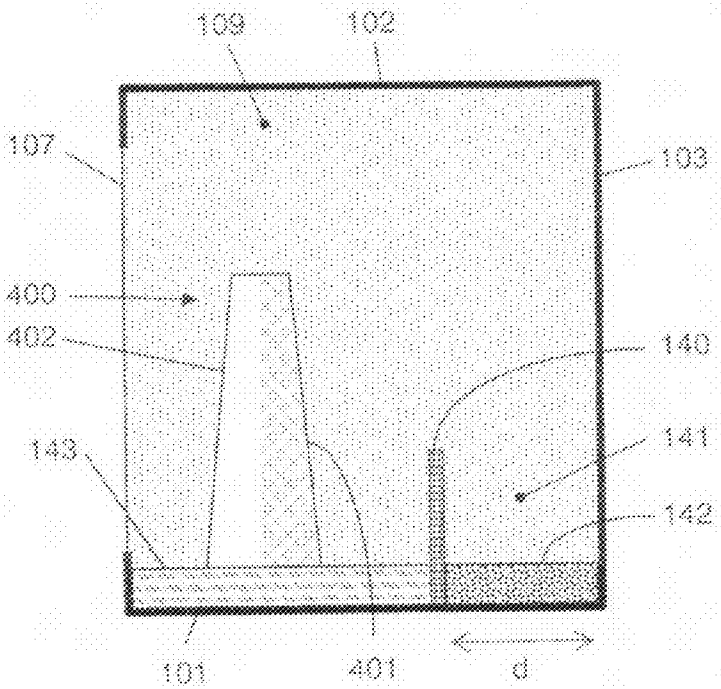
FIGS. 4A and 4B are views comparable to FIG. 2C, schematically illustrating a second trick.
Figure 4A:
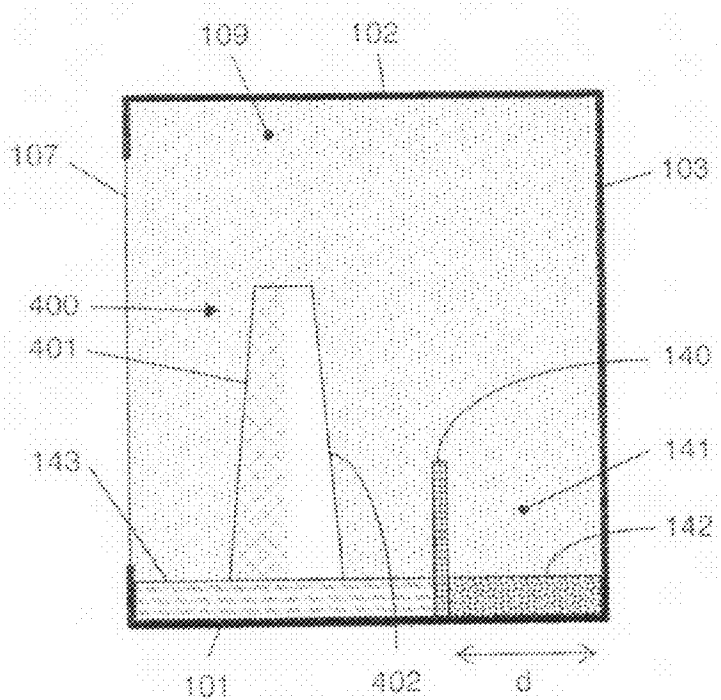

In a second example, illustrated in FIGS. 4A and 4B, an attribute 400 has two opposite surfaces 401 and 402. One surface 401 is entirely black, the opposite surface 402 is bright enough such as to be normally visible. The shape of the attribute 400 is basically immaterial, but for increased suspense the shape may for instance be an animal. The trick is played by placing the attribute 400 on the stage 143. When the second surface 402 is directed towards the opening 107, the attribute 400 is visible to the audience (FIG. 4B). When the conjurer, pronouncing a magical formula, turns the attribute 400 around so that the first surface 401 is directed towards the opening 107, the attribute 400 has magically disappeared (FIG. 4A). When the conjurer, pronouncing a different magical formula, turns the attribute 400 around again so that the second surface 402 is directed towards the opening 107, the attribute 400 has magically reappeared (FIG. 4B).

It is to be noted that the magical formula to be pronounced for making the secondary attribute 302 disappear is preferably identical to the magical formula to be pronounced for making the attribute 400 disappear. The same applies for the formulas to be pronounced for making the secondary attribute 302 or the attribute 400 appear.

Figure 5A:
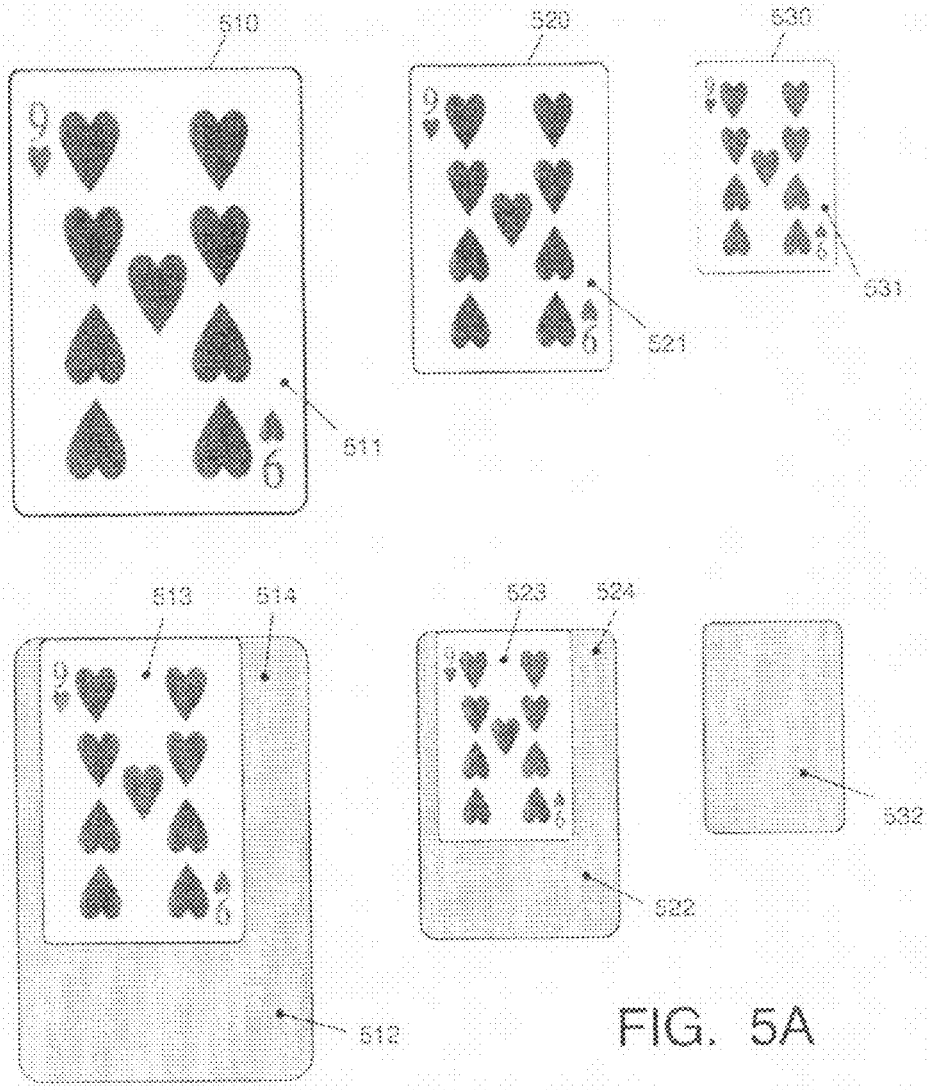
FIG. 5A schematically illustrates playing cards according to the present invention.
Figure 5B:
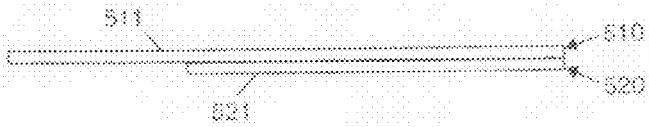
FIG. 5B schematically shows a stack of two of these playing cards for performing a third trick.

In a third example, illustrated in FIGS. 5A and 5B, a trick is played with a set of at least two, but preferably three cards 510, 520, 530. Each card has a front side 511, 521, 531 and a back side 512, 522, 532, respectively. Each front side 511, 521, 531 shows the same playing card (or other figure). Each back side 512, 522, 532 is at least partly black. A back side may be entirely black, but a back side may also comprise the face of the same playing card as the front side but at a smaller size. FIG. 5A shows a first playing card 510 having nine of hearts at its front side 511, while its back side 512 comprises a portion 513 containing the face of nine of hearts at a smaller size while the remainder portion 514 of the back side 512 is black. A second playing card 520 also has nine of hearts at its front side 521, while its back side 522 comprises a portion 523 containing the face of nine of hearts at a smaller size while the remainder portion 524 of the back side 522 is black. The size of second playing card 520 is substantially the same as the size of card portion 513 of the first card's back side 512. A third playing card 530 also has nine of hearts at its front side 531, while its back side 532 is completely black. The size of third playing card 530 is substantially the same as the size of card portion 523 of the second card's back side 522.

The different cards have mutually different sizes; the size ratio may for instance be about 1:1.5:2.

One trick is played with only one card having the same card figure at both sides yet with different sizes, such as card 510. By turning the card around, it seems as if the conjurer is magically capable of making a playing card increase or decrease in size. It is noted that the same type of trick would be possible with the attribute 400 of FIG. 4.

Figure 5E:
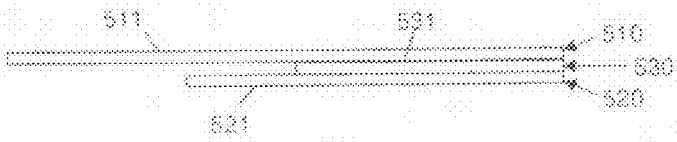
FIG. 5E schematically shows a stack of three of these playing cards for performing a variation of the third trick.
Figure 5D:
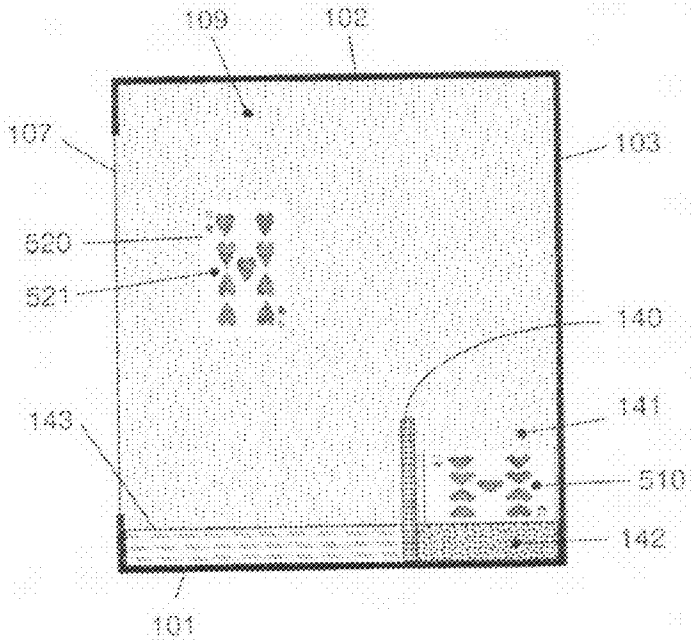
FIGS. 5C and 5D are views comparable to FIG. 2C, schematically illustrating the third trick.
Figure 5C:
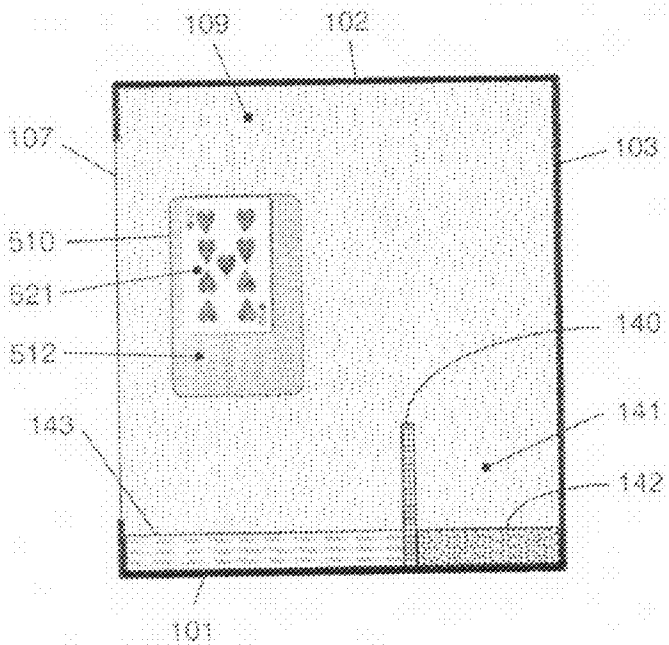

Another trick is played with two cards 510, 520 of different size, held back to back, as shown in FIG. 5B. In this trick, the cards back sides are entirely black. In a first step, the front side 511 of the larger card 510 is shown to the audience; the smaller card 520 is out of sight. In a second step, the conjurer holds the stack of cards 510, 520 inside the box 100, and turns the stack around so that the front side 521 of the smaller card 520 is facing the audience (FIG. 5C). The portion of the back side 512 of the larger card 510 not covered by the smaller card 520 is invisible because of its being black. In a third step, the conjurer drops the larger card 510 into the hiding space 141 behind the partitioning wall 140 so that this card is out of sight (FIG. 5D). The soft bottom cover 142 of the hiding space 141 prevents the audience from hearing the card drop. The conjurer can now take the smaller card 520 out of the box and show it to the audience. In a variation, the conjurer may use a stack containing the third card 530 in between the first and second cards 510, 520 and placed back to back with the second card 520 (FIG. 5E), so that the same trick can be repeated to magically "shrink" the card once more.

It should be clear to a person skilled in the art that the present invention is not limited to the exemplary embodiments discussed above, but that several variations and modifications are possible within the protective scope of the invention as defined in the appending claims. For instance, other objects may be used, partially black, to be placed in the magical theatre such as to be partially invisible.

The invention claimed is:

1. Conjurer's kit (1), comprising:

a box (100) comprising:

walls (101, 102, 103, 104, 105, 106) enclosing an interior (109) and having a display opening (107) in one front wall (106), wherein the inside surfaces of all walls are black;

a hiding space (141) defined between, a rear wall (103) and a partitioning wall (140) standing upright on a bottom (101) of the box, the partitioning wall having a height smaller than the interior height;

a bottom cover (142) of a soft material covering the bottom of the hiding space (141), the bottom cover (142) being made of foam or sponge or carpet ;

and at least one attribute (300; 400; 510; 520; 530) having at least one partially black outer surface.

2. Conjurer's kit according to claim 1, wherein the box (100) has a general block shape, with planar bottom (101), a top wall (102), a rear wall (103), side walls (104, 105), and a front wall (106), mutually perpendicular to each other.

3. Conjurer's kit according to claim 1, wherein the box (100) comprises:

a bottom part (110) consisting of a box bottom (101) and an upstanding rim (111);

a cover part (120) consisting of a box top wall (102) and an upstanding rim (121); and a wall part (130) consisting of a central box rear wall (103), two box side walls (104, 105) foldably attached to the box rear wall (103) at opposite edges thereof, and two strips (134, 135) foldably attached to the box side walls (104, 105), respectively at the free edges thereof opposite the central box rear wall (103).

4. Conjurer's kit according to claim 3, wherein the cover part (120) is larger than the bottom part (110) so that the cover part (120) can function as a lid on the bottom part (110) such as to together define a storage box.

5. Conjurer's kit according to claim 1, wherein the partitioning wall (140) extends from one side wall (104) to the opposite side wall (105), at a distance from the rear wall (103).

6. Conjurer's kit according to claim 1, wherein the partitioning wall (140) is a planar wall parallel to the rear wall (103).

7. Conjurer's kit according to claim 1, wherein the partitioning wall (140) is curved, with the convex size towards the opening (107).

8. Conjurer's kit according to claim 1, further comprising a raised stage portion (143) on the floor of the interior (109) between the partitioning wall (140) and the opening (107).

9. Conjurer's kit according to claim 1, wherein the at least one attribute (300; 400; 510; 520; 530) is a bottomless hollow hiding device (300) with a black outer surface.

10. Conjurer's kit according to claim 9, wherein the bottomless hollow hiding device (300) has a cone-shape.

11. Conjurer's kit according to claim 1, wherein the at least one attribute (310) comprises two bottomless hollow hiding devices (311, 312) of similar shape and slightly different sizes so that the smaller one (312) fits in the larger one (311) with little play, wherein the smaller one (312) has a black outer surface while the larger one (311) has a bright colour.

12. Conjurer's kit according to claim 11, wherein the two hiding devices (311, 312) are of soft and a flexible material, for instance plastic or rubber.

13. Conjurer's kit according to claim 11, further comprising an auxiliary object (313) having a bright colour and having a size such as to fit in the smaller one (312) of the hiding devices.

14. Conjurer's kit according to claim 1, wherein at least one attribute (300; 400; 510; 520; 530) is an object (400) having one black half (401) and an opposite non-black half (402).

15. Conjurer's kit according to claim 1, wherein at least one attribute (300; 400; 510; 520; 530) is a playing card (530) having a front face (531) with a playing card figure and a black back face (532).

16. Conjurer's kit according to claim 1, wherein at least one attribute (300; 400; 510; 520; 530) is a playing card (510) having a front face (511) showing a playing card figure and a back face (512) having a card portion (513) showing the same playing card figure as the front face (511), the remainder of the back face (512) being black.

17. Conjurer's kit according to claim 1, wherein the box (100) comprising:

walls (101, 102, 103, 104, 105, 106) enclosing an interior (109) and having a display opening (107) in one front wall (106), wherein the inside surfaces of all walls are black;

a hiding space (141) defined between a rear wall (103) and a partitioning wall (140) standing upright on bottom (101), the partitioning wall having a height smaller than the interior height;

a bottom cover (142) of a soft material covering the bottom of the hiding space (141), the bottom cover (142) being made of foam or sponge or carpet.

18. Conjurer's kit according to claim 17, wherein the box (100) has a general block shape, with planar bottom (101), a top wall (102), a rear wall (103), side walls (104, 105), and a front wall (106), all walls being mutually perpendicular to each other.

19. Conjurer's kit according to claim 17, wherein the box (100) comprises:

a bottom part (110) consisting of a box bottom (101) and an upstanding rim (111);

a cover part (120) consisting of a box top wall (102) and an upstanding rim (121); and a wall part (130) consisting of a central box rear wall (103), two box side walls (104, 105) foldably attached to the box rear wall (103) at opposite edges thereof, and two strips (134, 135) foldably attached to the box side walls (104, 105), respectively at the free edges thereof opposite the central box rear wall (103).

20. Conjurer's kit according to claim 17, wherein the cover part (120) is larger than the bottom part (110) so that the cover part (120) can function as lid on the bottom part (110) such as to together define a storage box.

21. Conjurer's kit according to claim 17 wherein the partitioning wall (140) extends from one side wall (104) to the opposite side wall (105), at a distance from the rear wall (103).

22. Conjurer's kit according to claim 17, wherein the partitioning wall (140) is a planar wall parallel to the rear wall (103).

23. Conjurer's kit according to claim 17, wherein the partitioning wall (140) is curved, with the convex size towards the opening (107).

24. Conjurer's kit according to claim 17, wherein the box further comprising a raised stage portion(143)on the floor of the interior (109) between the partitioning wall(140) and the opening(107).

* * * * *